US006851878B2

(12) United States Patent
Hemmerlin

(10) Patent No.: US 6,851,878 B2
(45) Date of Patent: Feb. 8, 2005

(54) PRINT MEDIA POSITIONING SYSTEM AND METHOD

(75) Inventor: Brian D. Hemmerlin, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/420,233

(22) Filed: Apr. 22, 2003

(65) Prior Publication Data

US 2004/0213619 A1 Oct. 28, 2004

(51) Int. Cl.[7] ..... B41J 13/076; B41J 13/30; B65H 9/16

(52) U.S. Cl. ..... 400/636; 400/579; 400/633; 400/641; 271/252

(58) Field of Search ..... 400/579, 633, 400/633.1, 633.2, 636, 641, 642; 271/248, 250, 251, 252

(56) References Cited

U.S. PATENT DOCUMENTS

| | | | | |
|---|---|---|---|---|
| 4,621,801 A | * | 11/1986 | Sanchez | 271/251 |
| 4,775,142 A | * | 10/1988 | Silverberg | 271/251 |
| 5,022,638 A | * | 6/1991 | Ifkovits, Jr. | 271/2 |
| 5,088,721 A | * | 2/1992 | Suzuki et al. | 271/293 |
| 5,188,468 A | * | 2/1993 | Dykes | 400/579 |
| 5,329,302 A | | 7/1994 | Fogle et al. | |
| 5,507,482 A | | 4/1996 | Tenpaku et al. | |
| 5,584,478 A | * | 12/1996 | Michels et al. | 271/251 |

* cited by examiner

*Primary Examiner*—Stephen R. Funk

(57) ABSTRACT

One embodiment of a positioning system for positioning a sheet of print media within a print media handling mechanism comprises a drive shaft that rotates about a drive shaft axis of rotation; and a drive roller mounted on the drive shaft, the drive roller driven by the drive shaft to rotate about an axis of rotation different from the drive shaft axis of rotation.

20 Claims, 3 Drawing Sheets

PRINT MEDIA POSITIONING SYSTEM AND METHOD

BACKGROUND

Print media handling mechanisms, for example, inkjet printers, may include a print head for printing an image on a sheet of print media in a printzone, and a drive system for moving the sheet through the printzone. The drive system may include a drive roller mounted on a shaft wherein the shaft may be positioned perpendicular to the direction of media travel. A pinch roller may pinch the sheet against the drive roller so that the drive roller advances the sheet along the print media travel path. To print an image the print head may be propelled back and forth across the sheet, in a direction perpendicular to the direction of travel of the sheet, depositing ink in a desired pattern on the sheet as the sheet is moved through the printzone by the drive roller. To facilitate printing of the image on the sheet in a correct position, one may desire to position the sheet of print media in a known location prior to printing thereon.

Many attempts have been made to correctly position a sheet in a known location prior to printing thereon. One such prior art device includes a tapered roller mounted on a drive shaft to rotate about the drive shaft axis so as to move a sheet laterally into a known position. However, tapered rollers may require a relatively long travel path to effect movement of the sheet through the required lateral distance. This is particularly true when there may be other forces acting on the sheet that may need to be overcome. For example, the force on the sheet in the direction of forward motion may need to be overcome in order to effect lateral motion. Moreover, tapered rollers may not function well when the print media travel path is curved back upon itself due to drag forces associated with the curved paper path and constraining forces on the sheet from other rollers. Additionally, tapered rollers may tend to rotate the media as it is moved laterally so that a corner of the sheet may contact a reference wall prior to the remainder of the sheet. Accordingly, tapered rollers may result in the corner of the sheet becoming bent thereby hindering alignment of the sheet in a known location or position.

SUMMARY

A positioning system for positioning a sheet of print media within a print media handling mechanism comprises a drive shaft that rotates about a drive shaft axis of rotation; and a drive roller mounted on the drive shaft, the drive roller driven by the drive shaft to rotate about an axis of rotation different from the drive shaft axis of rotation.

DETAILED DESCRIPTION OF THE DRAWINGS

Figure 1:
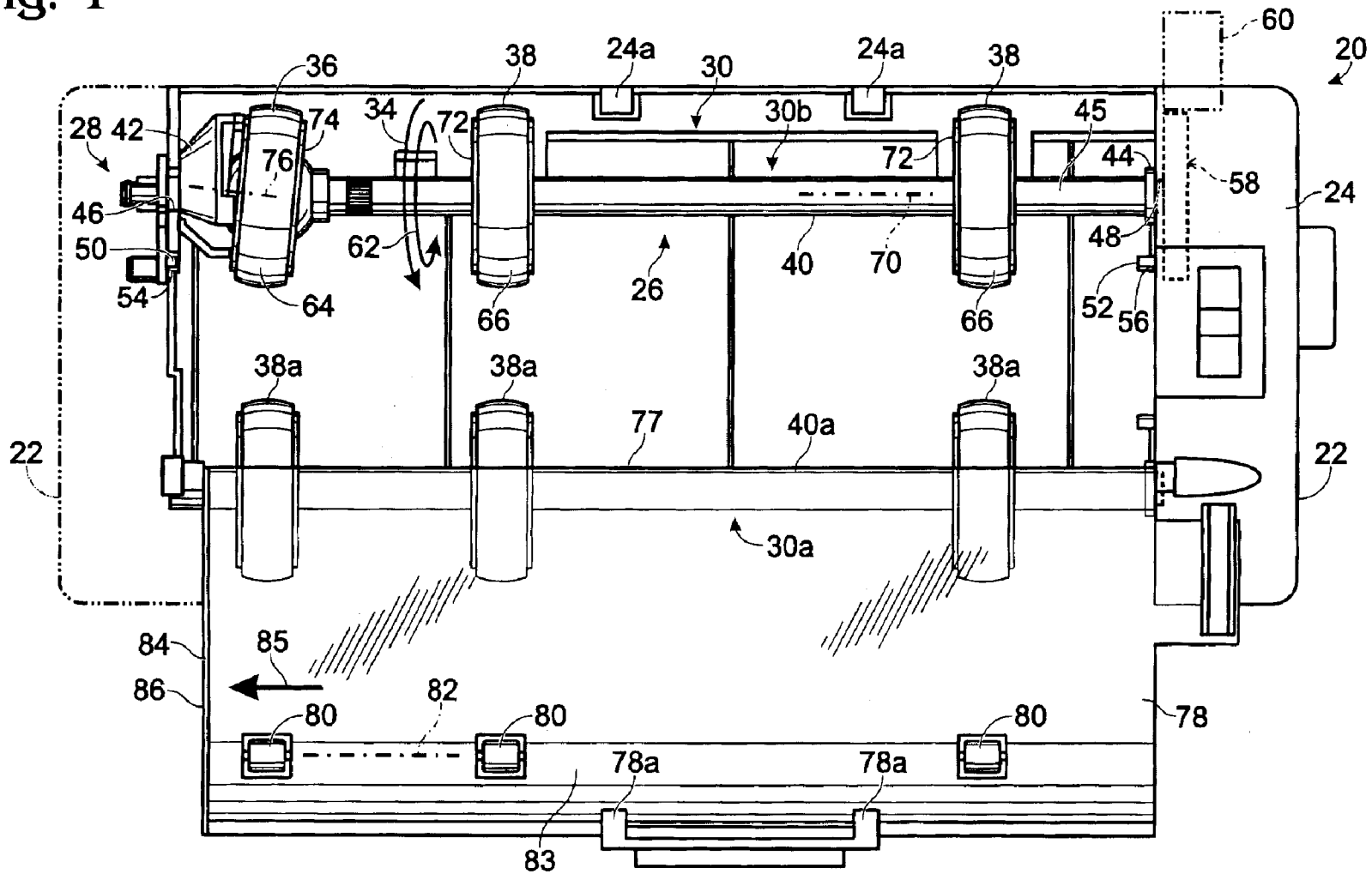
FIG. 1 is a rear, cut-away, perspective view of one form of a printing mechanism including one embodiment of a print media positioning system.

FIG. 1 illustrates a rear, cut-away, perspective view of an embodiment of a printing mechanism 20 constructed in accordance with the present invention. Printing mechanism 20 may be used for the printing of business reports, correspondence, desktop publishing, and the like, in an industrial, office, home or other environment. A variety of printing mechanisms are commercially available. For instance, some of the printing mechanisms that may embody the present invention include plotters, portable printing units, copiers, cameras, video printers, and facsimile machines, to name a few. For convenience, an example embodiment of the present invention is illustrated in the environment of inkjet printer 20. However, other printing mechanisms, such as laser printers, may also be used in embodiments of the present invention.

While it is apparent that the printer components may vary, an inkjet printer 20 may include a chassis 22 surrounded by a housing or casing enclosure 24, which may be manufactured of a plastic material. Sheets of print media may be fed through a printzone, indicated generally by reference numeral 26, by a print media handling system 28, constructed in accordance with one embodiment of the present invention. In other embodiments, printzone 26 may be located in a different region of printer 20. The print media may be any type of suitable material, such as paper, cardstock, transparencies, flexible film such as MYLAR®, and the like, but for convenience, the illustrated embodiment is described using a sheet of paper as the print medium.

The print media handling system 28 may have a feed tray (not shown) for storing sheets of paper before printing and a positioning or an aligning system 30, also referred to as a drive roller system 30, for moving the print media from the feed tray into printzone 26 for printing thereon. The embodiment of the printer shown in FIG. 1 may be duplex printer, meaning that the printer may automatically print an image on each side of a sheet of print media. Accordingly, after printing on one side of the sheet, the sheet typically may be re-fed to printzone 26 by drive roller system 30 for printing on the opposite side of the sheet. In the embodiment shown, a sheet 32 (see FIG. 2) of print media, such as a sheet 32, may be fed along a print media travel path 34 from the feed tray (not shown) to a lower region 30*a* of drive roller system 30. After printing on one side of sheet 32, the sheet may be moved further along print media travel path 34 by an upper region 30*b* of drive roller system 30 to printzone 26 for printing on a second side of the sheet. The positioning system of this embodiment the present invention may be used in a variety of different printing mechanisms with or without duplexing capabilities, and with or without upper and lower drive rollers. Contact of sheet 32 with the upper region 30*b* of drive roller system 30 as shown will now be described.

In the embodiment shown, positioning system 30 may comprise upper 30*b* and lower 30*a* drive rollers systems. The upper drive roller system 30*b* may include an off-axis drive roller 36, and two on-axis drive rollers 38, wherein each of rollers 36 and 38 may be positioned on a drive shaft 40. The lower drive roller system 30*a* may include a drive shaft 40*a* that may include three on-axis drive rollers 38*a*, wherein rollers 38*a* and drive shaft 40*a* may be used to move a sheet from the paper tray (not shown) to print zone 26 for printing on a first side of sheet 32 (see FIG. 2). In other embodiments, additional off-axis rollers may be provided on the same or on different drive shafts. Referring again to upper drive system 30*b*, rollers 36 and 38 and drive shaft 40 may then be used to move the printed sheet from print zone 26, and then return the sheet to printzone 26, with a second side of the sheet positioned for printing thereon.

Drive shaft 40 may be secured to housing 24 by a positioning device 42 and a bearing 44. Each of positioning device 42 and bearing 44 may be secured to housing 24 within grooves 46 and 48, respectively. Positioning device 42 and bearing 44 may also each include a lock 50 and 52, respectively, such as protrusions 50 and 52. Each protrusion may be secured within a mating aperture 54 and 56, respectively, in housing 24 to secure positioning device 42 and bearing 44 within grooves 46 and 48, respectively, and against rotational movement relative to housing 24. In the embodiment shown, shaft 40 may be adapted for rotational movement within stationary positioning device 42 and bearing 44. An end region 45 of each of drive shafts 40 and 40*a* may be connected to a gear system 58 (in this embodiment only drive shaft 40 is shown connected to gear system 58), which in turn is connected to a motor 60 (shown schematically), to rotate the drive shafts within housing 24.

With particular reference to the upper drive roller system 30*b*, motor 60 may rotate gear system 58 to cause rotation of drive shaft 40 in a drive direction 62 within positioning device 42 and bearing 44. Rollers 36 and 38 may be fixedly secured to drive shaft 40 such that rotation of drive shaft 40 in direction 62 will also result in rotation of rollers 36 and 38 in direction 62. Each of rollers 36 and 38 may include a gripping device which may be positioned on an outer surface of the roller, such as a tire 64 and 66, respectively, manufactured of a frictional material such as rubber or the like, for contacting and moving print media sheet 32 in drive direction 62 and along travel path 34.

Still referring to FIG. 1, drive shaft 40, in the embodiment shown, may define an elongate axis 70 positioned perpendicular to drive direction 62 and to travel path 34. Drive rollers 38 may be secured to drive shaft 40 by hubs 72 such that rollers 38 rotate about elongate axis 70. Accordingly, drive rollers 38 may be referred to as "on-axis" rollers. Drive roller 36 may be secured to drive shaft 40 by a hub 74 and may be positioned against positioning device 42 which may hold roller 36 at an off-axis position with respect to elongate axis 70 of drive shaft 40, such that drive roller 36 may rotate about a rotational axis 76 that is not aligned with elongate axis 70 of drive shaft 40. Accordingly, drive roller 36 may be referred to as an "off-axis" roller.

Positioning system 30 may further include a door 78 (shown in the open position) that is secured to housing 24 wherein door 78 may be opened to access print media handling system 28 and print media travel path 34. Door 78 may include a plurality of pinch rollers 80 mounted thereon, wherein a pinch roller 80 may be aligned with each of rollers 36 and 38 (when the door is in the closed position on housing 24). Pinch rollers 80 may be mounted on door 78 for rotation about a rotational axis 82, wherein axis 82 may be aligned parallel with axis 70 of drive shaft 40. Accordingly, when door 78 is in the closed position, pinch rollers 80 will pinch a sheet 32 of print media against drive rollers 36 and 38 such that rotation of rollers 36 and 38 will force sheet 32 to move in direction 62 along travel path 34. Door 78 may be maintained in the closed position on housing 24 by hinge 77 and by tabs 78*a* that are received within mating recesses 24*a* on housing 24. In another embodiment, the pinch roller aligned with off-axis roller 36 may also be positioned for off-axis rotation such that the pinch roller may rotate on an axis parallel to axis 76 of off-axis roller axis 36.

Door 78 may further include a paper guide 83, such as the relatively flat expanse of the door, and a reference structure 84, such as a reference wall 84, positioned along an edge 86 of door 78. Reference wall 84, in the embodiment shown, may be positioned extending along and parallel to print media travel path 34 and perpendicular to elongate axis 70 of drive shaft 40. Reference wall 84 may be positioned in a predetermined location with respect to printzone 26 such that when an edge of sheet 32 is positioned against reference wall 84 as the sheet is feed to printzone 26, the sheet will be correctly positioned for printing of an image thereon. Off-axis drive roller 36, due to its off-axis rotation with respect to elongate axis 70 of drive shaft 40, may tend to move sheet 32 of print media in a lateral direction 85 against reference wall 84 as the sheet is moved along travel path 34 and around off-axis drive roller 36, as will be described in more detail below. Accordingly, off-axis drive roller 36 may position sheet 32 in a known location prior to the sheet being fed by drive roller system 30 to printzone 26.

Figure 2:
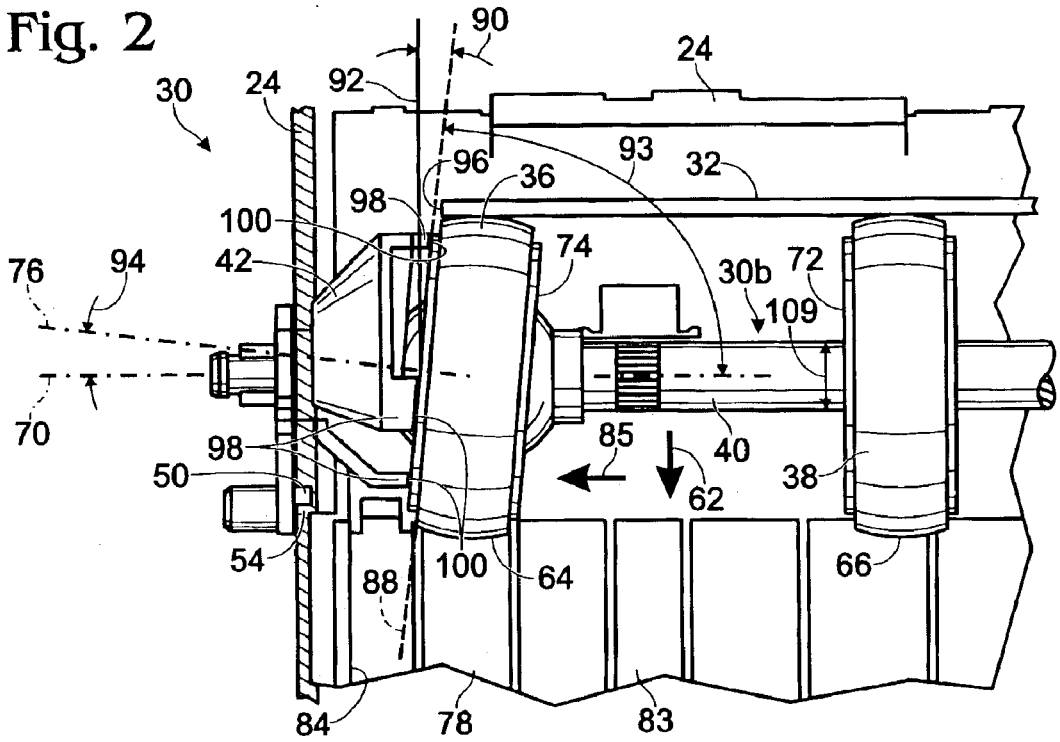
FIG. 2 is a rear view of the embodiment of the positioning system of FIG. 1, with a sheet of print media shown initially entering the positioning system.

FIG. 2 is a rear view of the drive roller system 30*b* of FIG. 1, with the sheet of print media 32 shown initially entering the positioning system 30. Off-axis drive roller 36 may be positioned by positioning device 42 to rotate about rotational axis 76. In this embodiment, positioning device 42 may define a plane of contact 88 with hub 74 of roller 36 such that roller 36 may define an angle 90 of approximately seven degrees from a perpendicular axis 92, and such that rotational axis 76 of roller 36 may be positioned at an angle 94 of approximately seven degrees from elongate axis 70. In other words, plane of contact 88 may be positioned at an acute angle 93 with respect to drive shaft axis of rotation 70. Positioning device 42 may define a plane of contact 88 positioned at angle 90 anywhere in a range of greater than zero degrees and less than ninety degrees, and generally greater than zero degrees and less than twenty five degrees, from perpendicular axis 92, for positioning sheet 32 against reference wall 84. In an example embodiment, angle 90 is greater than zero degrees and less than eight degrees because angles greater than eight degrees have been found to result in damage to sheet 32 in some applications. In particular, as the size of angle 90 is increased, the force against sheet 32 by roller 36 to move the sheet in lateral direction 85 and into position against reference wall 84 may be increased. Such an increased force may lead to bending of sheet 32 along its edge 96 when the edge is positioned against reference wall 84. Accordingly, angle 90 should be chosen to allow roller 36 to move sheet 32 against reference wall 84 as the sheet is moved by rollers 36 and 38 in direction 62, without bending or buckling of the sheet in edge region 96.

Tire 64 of off-axis roller 36 may include a rounded surface for contacting sheet 32 such that the tire 64 may contact the sheet at a predetermined radial distance from the center of hub 74, regardless of the degree to which roller 36 is off-axis, with respect to drive shaft axis 70. In the embodiment shown, the paper contacting surface of tire 64 defines a section of a sphere. In other embodiments, tire 64 may have any paper contacting shape as desired, such as a curved or a flat outer surface.

Still referring to FIG. 2, in the embodiment shown, plane of contact 88 may be defined by three extensions 98, also referred to as arms or projections, of positioning device 42. Each of three extensions 98 may define a contacting surface 100 for contacting hub 74 of off-axis roller 36. Contacting surfaces 100 may be angled to coincide with angle 90. In other words, in the embodiment shown, contacting surfaces 100 may each define an angle 90 of approximately seven degrees with respect to perpendicular axis 92 such that the contacting surfaces 100 abut squarely against hub 74. As stated earlier, protrusion 50 of positioning device 42 may be received within aperture 54 of housing 24 such that alignment device 42, and three extensions 98, may not rotate with rotation of drive shaft 40. However, off-axis roller 36 may rotate with drive shaft 40 such that hub 74 may contact stationary arms 98 as hub 74 and roller 36 rotate with drive shaft 40.

Drive shaft 40 may include structure to prevent translational movement of the shaft along a lateral direction 85 parallel to elongate axis 70. In the embodiment shown, the structure to prevent translational movement may be a stepped diameter, i.e., a diameter of the shaft that is smaller in some sections thereof, wherein the stepped diameter may be positioned within either positioning device 42 and/or bearing 44. In the embodiment shown, the diameter 109 of shaft 40 steps down to a smaller diameter at positioning device 42 (see FIG. 3). In this manner, hub 74 may be positioned abutting and in constant contact with each of three extensions 98 of positioning device 42 such that positioning device 42 may maintain hub 74, and off-axis roller 36, at off-axis angle 90 as roller 36 is rotated with rotation of drive shaft 40.

Figure 3:
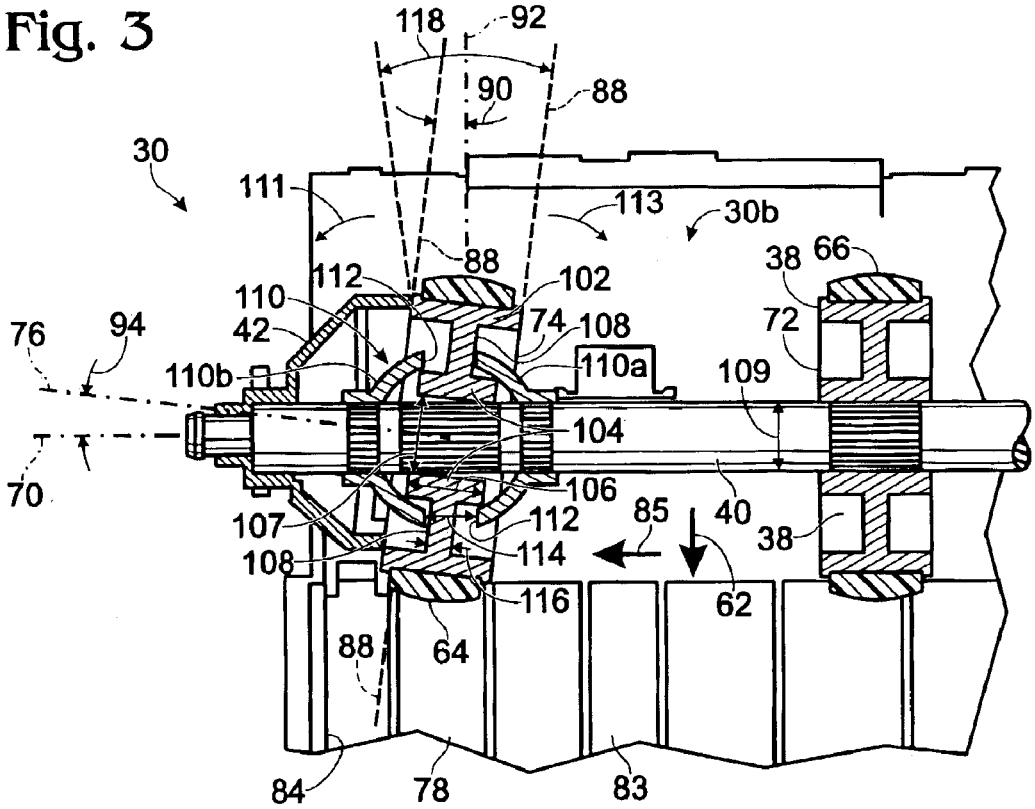
FIG. 3 is a rear, cross-sectional view of the embodiment of the positioning system of FIG. 2.

FIG. 3 is a rear, cross-sectional view of several components of drive roller system 30 of FIG. 2. Hub 74, in the embodiment shown, may include an outer rim 102 for supporting tire 64. Outer rim 102 may be connected to, or formed integrally with, an inner rim 104, having a width 106 and an inner diameter 107, by a plurality of spokes 108. Diameter 107 may be sufficiently larger than a diameter 109 of drive shaft 40 such that inner rim 104 may move back and forth in a lateral direction with respect to drive shaft 40. In the embodiment shown, hub 74 may include three spokes 108 (only two spokes are visible in this figure), but any number of spokes or other means sufficient to support outer rim 102 in a particular application may be used. Inner rim 104 may be secured within a ball joint 110 secured to drive shaft 40. Ball joint 110 may include a first section 110*a* and a second section 110*b* that are secured together to secure inner rim 104 therein. Sections 110*a* and 110*b* may be secured together by any securement device such as adhesive or by mating locks (not shown) on each of the corresponding sections 110*a* and 110*b*.

Ball joint 110 may include a plurality of apertures 112 through which spokes 108 extend. In the embodiment shown, ball joint 110 may include three apertures 112. Apertures 112 may have a width 114 smaller than width 106 of inner rim 104 of hub 74. Accordingly, hub 74 may be retained on ball joint 110 and, therefore, on drive shaft 40 by ball joint 110. The width 114 of apertures 112 of ball joint 110 may be larger than the width 116 of spokes 108 such that hub 74 may rock back and forth in directions 111 and 113 with respect to ball joint 110. Hub 74, therefore, in the embodiment shown, may move with respect to ball joint 110 through an angle 118 of approximately sixty degrees, wherein angle 118 is centered on perpendicular axis 92. Accordingly, due to the large range of movement allowable between hub 74 and ball joint 110, placement of positioning device 42 against hub 74 may define the angles 90 and 94 of hub 74 with respect to drive shaft 40 and drive shaft axis 70. Of course other dimensions of the alignment device 42 may be utilized so as to allow angles 90 and 94 to be any acute angle as desired for a particular application.

Due to the off-axis orientation of roller 36, i.e., due to rotation of roller 36 about axis of rotation 76, roller 36 may impart a force to sheet 32 in a direction parallel to feed direction 62 and a force to sheet 32 in a lateral direction 85, i.e., in a direction perpendicular to feed direction 62. Accordingly, as sheet 32 moves in direction 62 along travel path 34, the sheet may also be moved laterally in direction 85 until an edge 96 (see FIG. 2) of the sheet contacts reference wall 84. Upon contact of the sheet with reference wall 84, the wall 84 may impart an opposing lateral force to sheet 32 such that the sheet may not continue to move toward wall 84 but may continue to be moved in direction 62. In this manner, sheet 32 may be positioned in a known location, i.e., with sheet edge 96 positioned squarely against wall 84, as the sheet is fed to printzone 26 for printing thereon.

Figure 4:
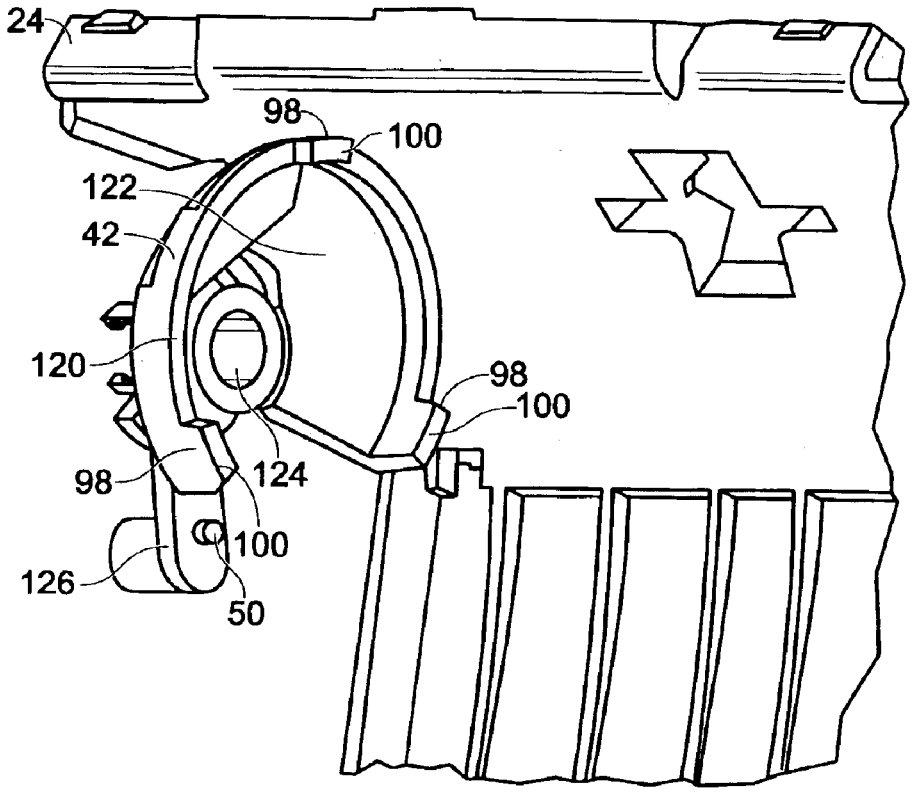
FIG. 4 is a rear, perspective view of one embodiment of a positioning device of FIG. 2.

FIG. 4 is a rear, perspective view of positioning device 42 of FIG. 2. Three extensions 98 are shown positioned on an edge region 120 of a conical rim section 122 that may taper down to an aperture 124 for receiving drive shaft 40 (see FIG. 3). Protrusion 50, which may be used to retain positioning device 42 stationary with respect to housing 24, is shown on a downwardly extending arm 126 of positioning device 42.

Positioning device 42, bearing 44 (see FIG. 1), hub 74 (see FIG. 3), and ball joint 110 (see FIG. 3) may each be manufactured of plastic. Drive shaft 40 (see FIG. 1) may be manufactured of steel. Outer tires 64 and 66 (see FIG. 1) may be manufactured of rubber. However, any materials suitable for the needs of a particular application may be utilized for any of the components of the printing mechanism of the present invention.

Figure 5:
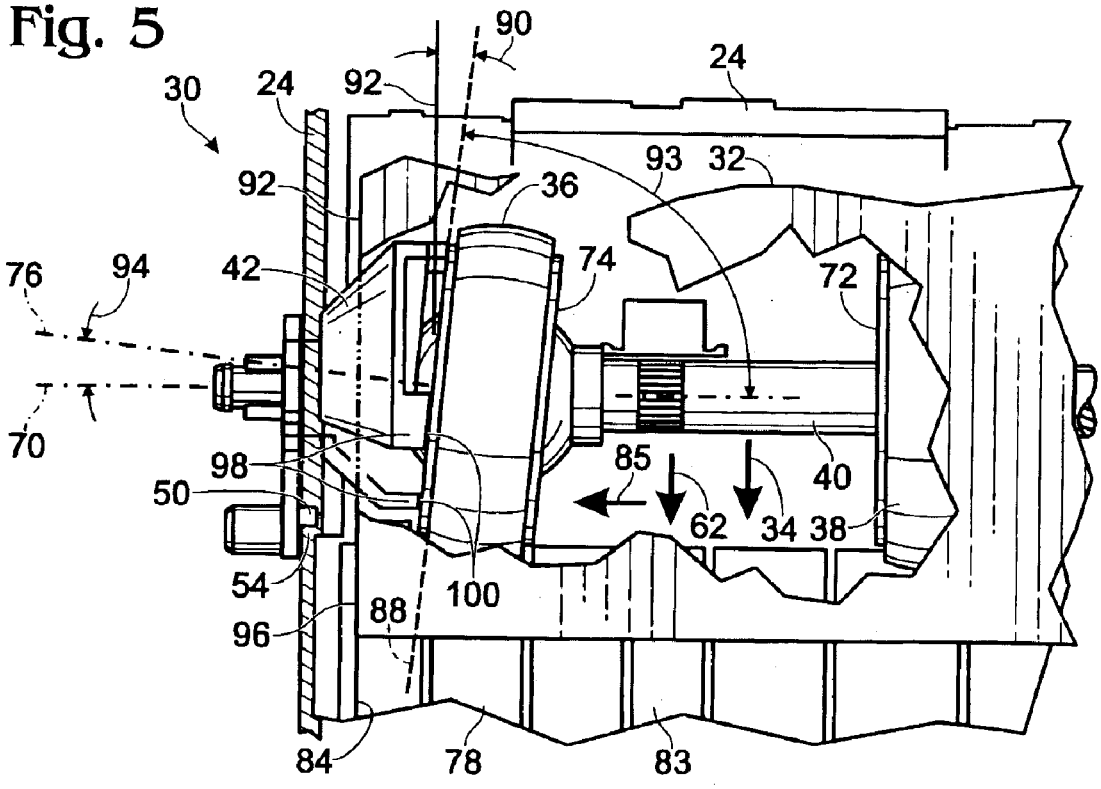
FIG. 5 is a rear view of one embodiment of a positioning system of FIG. 2, with the sheet of print media shown moved laterally into position against a reference wall of the printing mechanism.

FIG. 5 is a rear view of the positioning system of FIG. 2, with the sheet of print media 32 shown moved into position against reference wall 84 of printing mechanism 20. In particular, as drive rollers 36 and 38 are rotated by rotation of drive shaft 40 about elongate axis 70, rollers 36 and 38 may impart a driving force to sheet 32 in the direction 62 of print media travel path 34. However, due to the off-axis orientation of drive roller 36, drive roller 36 may also impart a driving force to sheet 32 in lateral or translational direction 85 perpendicular to print media travel path 34. As sheet 32 moves along travel path 34, the sheet may be moved in direction 85 closer to reference wall 84 until edge 96 of sheet 32 is positioned flush against reference wall 84. After contact of edge 96 of sheet 32 against reference wall 84, the sheet may no longer move in direction 85 but may continue to move in the direction of print media travel path 34 and into printzone 26. The off-axis angle 90 of roller 36 may be chosen to achieve positioning of each sheet 32 against reference wall 84 prior to or as the sheet is fed to printzone 26. Accordingly, the sheet may be correctly positioned in a known location for printing of an image thereon.

Thus, referring to all the figures, a variety of advantages are realized using the positioning system of the present invention. Positioning system 30 may provide an off-axis roller 36 that is driven by on-axis gear system 58, which also may drive on-axis rollers 38 and 38*a*. Accordingly, an additional gear system and an additional motor may not be required for driving off-axis roller 36. Moreover, complex off-axis gearing may not be required. The positioning system may also allow the gear system 58 that drives both rollers 36 and 38 to be positioned opposite drive shaft 40 from reference wall 84. Such positioning of gear system 58 may allow for a compact design of print mechanism 20. Positioning device 42 may also function as a bearing for retaining shaft 40 on housing 24, thereby reducing the number of parts required for manufacture of printer 20. Off-axis roller 36 may move a sheet 32 further in perpendicular direction 85 over a given distance in drive direction 62 than the on-axis, tapered roller designs of the prior art. The off-axis positioning device 42 may also move sheet 32 in direction 85 perpendicular to drive direction 62 without any rotational motion of the sheet, as may tend to be induced by the tapered roller designs of the prior art. The off-axis roller 36 of the present invention may also provide significant amounts of drive force and may therefore be used to drive a sheet 32 around curved travel path 34, i.e., back upon itself around drive roller 36 and 38.

The illustrated embodiment of FIGS. 1–5 is shown to illustrate the principles and concepts of the invention as set forth in the claims below, and a variety of modifications and variations may be employed in various implementations while still falling within the scope of the claims below.

I claim:

1. A positioning system for positioning a sheet of print media within a print media handling mechanism, comprising:

a drive shaft that rotates about a drive shaft axis of rotation; and a drive roller mounted on said drive shaft, said drive roller driven by said drive shaft to rotate about a drive roller axis of rotation that is different from said drive shaft axis of rotation, wherein said drive roller axis of rotation is positioned at an angle greater than zero and up to and including eight degrees with respect to said drive shaft axis of rotation.

2. A positioning system according to claim 1 further comprising a positioning device mounted on said drive shaft and contacting said drive roller, said positioning device defining a plane of contact with said drive roller wherein said plane of contact is positioned at an acute angle with respect to said drive shaft axis of rotation.

3. A positioning system according to claim 1 wherein said drive roller is mounted on said drive shaft by a ball joint wherein said ball joint could allow movement of said drive roller through an angle of at least sixty degrees with respect to said drive shaft, said angle centered on a plane positioned perpendicular to said drive shaft axis of rotation.

4. A positioning system according to claim 1 wherein said drive roller is adapted for moving a sheet of print media along a travel path perpendicular to said drive shaft axis of rotation and in a direction parallel to said drive shaft axis of rotation, said positioning system further comprising a reference wall positioned parallel to said travel path of said sheet of print media.

5. A method of positioning a print media, comprising the steps of:

rotating a drive shaft about a drive shaft axis of rotation;

rotating a drive roller, by rotation of said drive shaft, about a drive roller axis of rotation that is different from said drive shaft axis of rotation; and providing a sheet of print media to said drive roller wherein rotation of said drive roller moves said sheet of print media perpendicular to and parallel to said drive shaft axis of rotation, wherein said drive roller axis of rotation is positioned at an angle greater than zero and up to and including eight degrees with respect to said drive shaft axis of rotation.

6. The method according to claim 5 further comprising the step of mounting an alignment device on said drive shaft, wherein said alignment device maintains said drive roller in position for rotation about said drive roller axis of rotation.

7. The method according to claim 5 wherein said step of providing a sheet comprises providing a sheet having an image printed on a first side thereof, and wherein rotation of said drive shaft moves said sheet into a printzone for printing on a second side of said sheet.

8. An alignment device for aligning a sheet of print media in a known location within a printing mechanism, comprising:

a body that defines a drive shaft aperture adapted for receiving a drive shaft therein, wherein said drive shaft aperture defines a drive shaft axis of rotation; and a drive roller contact surface on said body that defines a plane of contact for contact with a drive roller, wherein said plane of contact is positioned at an acute angle greater than zero and up to and including eight degrees with respect to said drive shaft axis of rotation.

9. An alignment device according to claim 8 further comprising a drive shaft positioned within said drive shaft aperture and a drive roller mounted on said drive shaft such that rotation of said drive shaft causes rotation of said drive roller and wherein said drive roller contact surface of said alignment device forces said drive roller to rotate with said drive shaft about an axis positioned at an acute angle with respect to said drive shaft axis of rotation.

10. An alignment device according to claim 9 wherein said drive roller includes a hub and a ball joint, wherein said ball joint is fixedly mounted on said drive shaft and said hub is moveably mounted on said ball joint such that said hub is adapted for movement through an angle in a range of one to sixty degrees, said angle centered on a plane positioned perpendicular to said drive shaft axis of rotation.

11. An alignment device according to claim 10 wherein said ball joint comprises a plurality of apertures on an outer surface thereof, and wherein said hub comprises a plurality of mating spokes wherein ones of said spokes each extend through a corresponding aperture on said ball joint.

12. A positioning system for positioning a sheet of print media within a print media handling mechanism, comprising:

drive means for rotating about a drive means axis of rotation; and roller means for rotating about a roller means axis of rotation that is positioned at an angle greater than zero and up to and including eight degrees with respect to said drive means axis of rotation, wherein said roller means is rotated by said drive means.

13. A positioning system for positioning a sheet of print media within a print media handling mechanism, comprising:

a drive shaft that rotates about a drive shaft axis of rotation; and a drive roller mounted on said drive shaft, said drive roller driven by said drive, shaft to rotate about a drive roller axis of rotation that is different from said drive shaft axis of rotation, wherein said drive roller includes a print media contacting surface mounted on a hub, wherein said positioning system further includes a ball joint mounted on said drive shaft, said hub being captured by said ball joint wherein said ball joint allows movement of said hub through an angle of at least two degrees and less than sixty degrees with respect to said drive shaft, said angle centered on a plane positioned perpendicular to said drive shaft axis of rotation, and said positioning system further including an alignment device mounted on said drive shaft and contacting said hub so as to maintain said drive roller axis of rotation at an acute angle with respect to said drive shaft axis of rotation as said hub is rotated with said drive shaft.

14. A positioning system for positioning a sheet of print media within a printing mechanism, comprising;

a housing including a reference wall;

a drive shaft mounted in said housing, said drive shaft adapted for rotation about a drive shaft axis of rotation;

a drive roller mounted on said drive shaft; and an alignment device mounted on said drive shaft, wherein said alignment device maintains said drive roller on a drive roller axis of rotation that is different from said drive shaft axis of rotation such that rotation of said drive shaft causes rotation of said drive roller about said drive roller axis of rotation; wherein rotation of said drive roller imparts movement of a sheet of print media toward said reference wall to position said sheet against said reference wall, wherein said drive roller includes a print media contacting surface mounted on a hub captured by a ball joint mounted on said drive shaft wherein said ball joint allows movement of said hub through an angle of at least two degrees and less than sixty degrees with respect to said drive shaft.

15. A printer comprising:

a housing;

a reference structure;

a drive shaft mounted on said housing and adapted for rotation about a drive shaft axis of rotation;

a drive roller mounted on said drive shaft and adapted for rotating with said drive shaft about a drive roller axis of rotation, wherein said drive roller axis of rotation is different from said drive shaft axis of rotation, and wherein rotation of said drive roller is adapted to move a sheet of print media along a travel path and in a direction parallel to said drive shaft axis and into contact with said reference structure, wherein said drive roller is an off-axis drive roller, and said printer further comprises an on-axis drive roller mounted on said drive shaft for rotation with said drive shaft about said drive shaft axis of rotation.

16. A printer according to claim 15 further comprising an alignment device mounted on said drive shaft and contacting said drive roller, said alignment device maintaining said drive roller at an acute angle with respect to said drive shaft axis of rotation.

17. A printer according to claim 16 wherein said alignment device secures said drive shaft to said housing.

18. A printer according to claim 15 wherein said drive roller is movably mounted on said drive shaft such that said drive roller is adapted to move within an angle of movement of at least sixty degrees centered on a plane positioned perpendicular to said drive shaft axis of rotation.

19. A printer according to claim 15 further comprising a second drive shaft including a plurality of drive rollers thereon and a gear system that rotates said drive shaft and said second drive shaft.

20. A printer comprising:

a housing;

a reference structure;

a drive shaft mounted on said housing and adapted for rotation about a drive shaft axis of rotation;

a drive roller mounted on said drive shaft and adapted for rotating with said drive shaft about a drive roller axis of rotation, wherein said drive roller axis of rotation is different from said drive shaft axis of rotation, and wherein rotation of said drive roller is adapted to move a sheet of print media along a travel path and in a direction parallel to said drive shaft axis and into contact with said reference structure, wherein said reference structure comprises a door mounted on said housing, and wherein a pinch roller is positioned on said door and aligned with said drive roller, said pinch roller adapted for forcing a sheet of print media against said drive roller during movement of said print media along said travel path.

* * * * *